US012708824B2

(12) United States Patent
Palairet

(10) Patent No.: US 12,708,824 B2
(45) Date of Patent: Aug. 18, 2026

(54) GOLF TEE

(71) Applicant: Trevor Palairet, Inverness (AU)

(72) Inventor: Trevor Palairet, Inverness (AU)

( * ) Notice: Subject to any disclaimer, the term of this patent is extended or adjusted under 35 U.S.C. 154(b) by 0 days.

(21) Appl. No.: 18/731,428

(22) Filed: Jun. 3, 2024

(65) Prior Publication Data

US 2024/0316424 A1 Sep. 26, 2024

Related U.S. Application Data

(63) Continuation of application No. 17/857,056, filed on Jul. 4, 2022, now Pat. No. 12,005,329, which is a continuation-in-part of application No. 17/000,340, filed on Aug. 23, 2020, now Pat. No. 11,376,480.

(51) Int. Cl.
*A63B 57/10* (2015.01)

(52) U.S. Cl.
CPC ..... *A63B 57/10* (2015.10)

(58) Field of Classification Search
CPC ..... A63B 57/10; A63B 57/15; A63B 57/19
See application file for complete search history.

(56) References Cited

U.S. PATENT DOCUMENTS 1,679,579 A * 8/1928 Lundy ..... A63B 57/10 473/401
1,692,191 A * 11/1928 Towsley ..... A63B 57/10 473/403
4,645,208 A * 2/1987 Morabeto ..... A63B 57/10 473/396
5,403,006 A * 4/1995 Korte-Jungermann ..... A63B 60/08 473/284
5,571,055 A * 11/1996 Lewis ..... A63B 57/10 473/402
6,186,907 B1 * 2/2001 Woodward ..... A63B 57/13 473/400
6,454,669 B1 * 9/2002 James ..... A63B 57/13 473/387
7,691,011 B1 * 4/2010 Roman ..... A63B 57/16 473/387
8,403,776 B1 * 3/2013 Gruenwald ..... A63B 57/10 473/387
8,622,853 B1 * 1/2014 Roland ..... A63B 69/3623 473/394
9,561,415 B2 * 2/2017 Rost ..... A63B 57/15
11,376,480 B1 * 7/2022 Palairet ..... A63B 57/10
12,005,329 B2 * 6/2024 Palairet ..... A63B 57/10
2002/0022538 A1 * 2/2002 Choi ..... A63B 57/13 473/396
2005/0261087 A1 * 11/2005 Walters ..... A63B 57/10 473/396
2006/0166765 A1 * 7/2006 Holtzman ..... A63B 57/10 473/387

(Continued)

FOREIGN PATENT DOCUMENTS

DE 202004003847 U1 * 7/2004 ..... A63B 57/10
GB 2048082 A * 12/1980 ..... A63B 57/10

(Continued)

*Primary Examiner* — Audrey B. Walter
(74) *Attorney, Agent, or Firm* — Michael D. Eisenberg

(57) ABSTRACT

A golf tee is disclosed, which is resistant to breaking and resistant to flying. The golf tee herein comprises a head; a stem; a ground-gripping ring or rings; and a terminal grounding tool.

6 Claims, 10 Drawing Sheets

(56) References Cited

U.S. PATENT DOCUMENTS

| | | | | |
|---|---|---|---|---|
| 2010/0173731 | A1* | 7/2010 | Schneider | A63B 57/19<br>473/403 |
| 2017/0106258 | A1* | 4/2017 | Rost | A63B 57/10 |
| 2017/0157477 | A1* | 6/2017 | Carroll, Jr. | A63B 57/10 |
| 2019/0030406 | A1* | 1/2019 | Baker | A63B 57/10 |
| 2020/0353330 | A1* | 11/2020 | Bedard | A63B 57/10 |

FOREIGN PATENT DOCUMENTS

| | | | | |
|---|---|---|---|---|
| GB | 2574259 | A * | 12/2019 | A63B 57/10 |
| KR | 20110123966 | A * | 11/2011 | A63B 57/0032 |
| WO | WO-0102063 | A1 * | 1/2001 | A63B 57/10 |

* cited by examiner

GOLF TEE

CROSS-REFERENCES TO RELATED APPLICATIONS

The present application is a continuation of U.S. application Ser. No. 17/857,056 filed Jul. 4, 2022, which is a continuation-in-part of U.S. application Ser. No. 17/000,340 filed on Aug. 23, 2020 and issued as U.S. Pat. No. 11,376,480, both of which are hereby incorporated in their entirety.

TECHNICAL FIELD

This invention relates to golf tees.

BACKGROUND OF THE INVENTION

Many varieties of tees exist, each of which has different groups of properties. The problems with existing varieties of tees in common use include: (i) the tee is too fragile and readily breaks; (ii) the tee flies out of the ground when hit and is lost or needs to be fetched, which takes time and detracts from enjoyment of the game; (iii) the golf ball is difficult to place on the tee, especially for an older golfer with shaky hands, due to an unsuitable ball-support platform, especially the types that claim low friction; (iv) the tee cannot be inserted into the ground in the conventional way, using the golf ball, as the head does not support the required downward pressure (e.g., the 'brush tee' or rubber or silicon ball support varieties); (v) the tee is too expensive, while not delivering true value in terms of ease of use, practicality, durability and ability to remain in the ground or very near the golfer following the tee shot; (vi) the tees are hard to insert into the ground due to the stem being too flexible; (vii) the tees are not compliant with existing regulations, which do not allow any indication of directionality; and (viii) the tees, which are easily broken or fly-off easily and thus are frequently lost and represent a littering issue. No existing tee addresses all of the above issues.

The tees of common usage, which fracture easily and those that routinely fly far when hit and are lost, tend to be: (i) cheap; (ii) mass-produced; and (iii) sold in large quantities. The tees of common usage that typify mass-produced tees include the traditional wooden tees and the bulky-headed flexible plastic tee varieties, which both sell very well. The perception of the golfer who purchases these varieties of tees of common use include: (i) these tees are easy to use in their local ground conditions; (ii) the golfer is familiar with these tees; and (iii) the tees are cheap to buy. The selling of these tees in large quantity lots is an acknowledgement that they are frequently broken or lost and represent a littering issue. Some tees of common usage are composed of several parts and designed to address the issues of the tee flying and fracturing. Drawbacks of these tees of common usage are: (i) increased cost; (ii) inconvenient to use; and (iii) not performing the way they are supposed to, while still breaking apart or flying away.

To correct these drawbacks, golf tees are manufactured such that they are: (1) presented in bright colors; (2) composed of strong composite materials; (3) constructed of multiple of assembled parts; (4) configured to be not aerodynamic; (5) composed of biodegradable materials; and (6) composed of natural materials that disintegrate upon impact. However, these corrective measures impose the following other drawbacks.

Drawbacks to Corrective Measure 1: A commonly expounded compensation for tee of common usage that flies out of the ground is the use of bright colors. The bright colors are supposed to make the tee easier to find after flying out of the ground. Golfers are aware that there can still be difficulty in finding those tees of common usage with bright colors, especially some styles that can fly up to 10 meters. Sticks, leaves, or long grass in the teeing ground vicinity also compound this issue, which can frustrate golfers and contribute to littering on the golf course.

Drawbacks to Corrective Measures 2 and 3: Strong composite materials and multiple assembled parts (e.g., inbuilt springs or an attached anchor component) are used to address the issues of the tee flying and fracturing. These varieties are associated with increased cost, while rarely addressing both tee flying and fracturing. Further, tees composed of composite materials and multiple assembled parts are not always convenient to use, which require additional time to set up.

Drawbacks of Corrective Measure 4: Non-aerodynamic golf tees are designed to initially fly out, and then not fly too far out. These tees, which still fly and need to be fetched, are asymmetrical and so they are non-compliant with United States Golf Association (USGA) rules.

Drawbacks of Corrective Measures 5 and 6: While biodegradable and natural material materials that disintegrate upon impact reduce littering, golf tees composed of these materials tend to be more expensive, limited to single use, and reduced durability.

A big-focus in golf tee marketing and design is based on the assertion that a tee can exert a significant effect on the quality of the tee shot due to drag or friction. For example, there are tee varieties that claim to be able to increase the distance of a drive or provide for a drive without affecting spin. In the attempt to adjust for this claimed significant friction, tees in current use are not suitable to perform their main role of securely supporting the golf ball and being easy to use.

What is needed is a tee that can address the drawbacks, as described above.

BRIEF SUMMARY OF THE EMBODIMENTS OF THE INVENTION

An aspect of some embodiments of the present invention relates to a golf tee, comprising a head, a body, and a downwardly sloping skirt. The head configured to support a golf ball. The body operatively connects to the head and is located below the head, and the body comprises: a stem below the head, a gripping ring structure below the stem, and a terminal grounding tool below the gripping ring structure, wherein the gripping structure is configured to be at least partially buried in a ground in which the golf tee is lowered and to grip the ground, and wherein the terminal grounding tool culminates in a pointy tip. The downwardly sloping skirt surrounds at least part of the body, the skirt having a top circumference joined to the body and a bottom circumference larger than the top circumference, wherein below the top circumference a hollow space is formed between the skirt and the body, when the terminal grounding tool is fully buried in the ground and the bottom circumference contacts the ground.

In a variant, the downwardly sloping skirt surrounds at least part of the stem, the top circumference is joined to the stem, the bottom circumference is vertically aligned with a junction between the stem and the gripping ring structure or is located above the junction, wherein below the top circumference a hollow space is formed between the skirt and the stem, when the gripping ring structure is fully buried in the ground.

In another variant, an angle between the central axis and an inclined surface of the skirt connecting the top circumference and the bottom circumference is between 75 and 80 degrees.

An aspect of some embodiments of the present invention relates to a golf tee, comprising a head and body. The head is configured to support a golf ball. The body operatively connects to the head and located below the head, and the body comprises: a stem below the head, a gripping ring structure below the stem, and a terminal grounding tool below the gripping ring structure, wherein the gripping structure is configured to be at least partially buried in a ground in which the golf tee is lowered and to grip the ground, and wherein the terminal grounding tool culminates in a pointy tip. The golf tee extends along a central axis, has a height extending from a top of the head to the pointy tip along the central axis, and has a center of mass of the golf tee located at a distance of 40% to 60% of the height from the pointy tip along the central axis.

BRIEF DESCRIPTION OF THE FIGURES

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Figure 2:
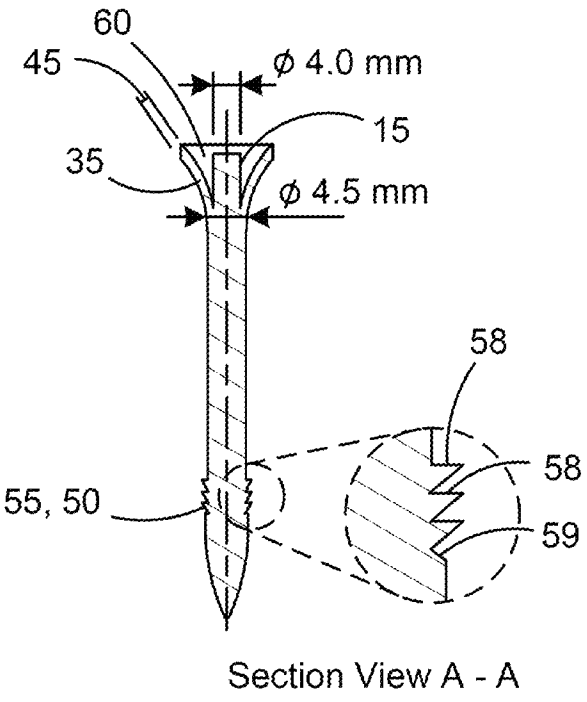
FIG. 2 is a section view of the golf tee of FIG. 1, through the line A-A, in accordance with the principles of the invention.

The figures are not intended to be exhaustive or to limit the invention to the precise form disclosed. It should be understood that the invention can be practiced with modification and alteration and that the invention be limited only by the claims and the equivalents thereof.

Some of the figures included herein illustrate various embodiments of the invention from different viewing angles. Although the accompanying descriptive text may refer to such views as "top", "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

The features of the systems and methods herein directed to a golf tee that is highly durable. This tee, which has a functional golf ball holding head, is sturdy enough for a wider range of tee ground conditions and does not fly out of the ground. Therefore, the tee solves the issues of tees in current use.

The present invention is described herein in terms of example embodiments. After reading this description, it will become apparent to one of ordinary skill in the art how the invention can be implemented in different and alternative embodiments.

From time-to-time, the present invention is described herein in terms of example environments. Description in terms of these environments is provided to allow the various features and embodiments if the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications, that are herein incorporated by reference, the definition set forth in this document prevails over the definition that is incorporated herein by reference.

Referring to FIGS. 1-7, exemplary, non-limiting the dimensions are in millimeter (mm). Golf tee 10 (e.g., GOLDWOLF™ and TENACITEE™) with head 12, overcomes all of the existing failures seen in golf tees of common usage, without compromising the beneficial aspects of golf tees of common usage. Benefits of golf 10 include: (i) maximum ease of use due to the wide and stable ball holding platform; (ii) sturdier construction which is adaptable to a wider range of teeing ground conditions; (iii) fracture resistance due to shock-absorbing features; (iv) non-flying capability due to gripping features, which is absent from existing tees; (v) mitigation of drag on the golf ball to avoid interference with tee shots due to the design of head 12; and (vi) pleasing aesthetic and quality finish.

Figure 1:
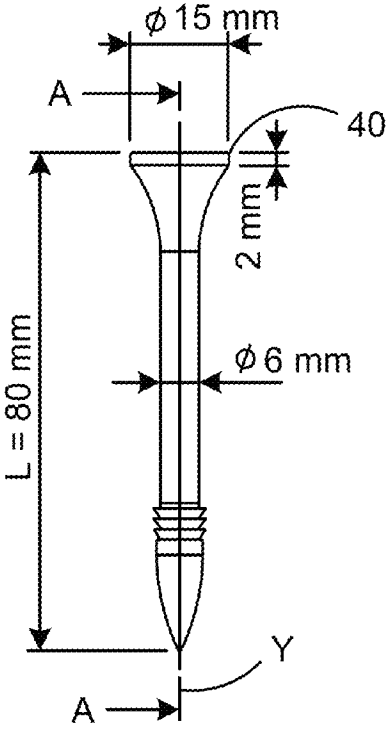
FIG. 1 is a front view of a preferred golf tee, in accordance with the principles of the invention.

In FIG. 1, golf tee 10 has a length L of 80.0 mm from outer wall 40 to the pointy tip along the vertical central axis Y. Outer wall 40 is 2.0 mm long and 15.0 mm wide. The middle section of golf tee 10 is a stem that is 6.0 mm wide.

In FIG. 2, golf tee 10 has central pillar 15, which sits within a hollowed out portion 60, wherein central pillar 15 has a width of 4 mm at the top and 4.5 mm at the bottom. Wall 35, which has a ball-support rim 45, connects to body 20. A gripping ring structure 55 (which includes gripping rings 50) and terminal grounding tool 30 with a pointy tip are on the lower end of body 20.

Figure 3:
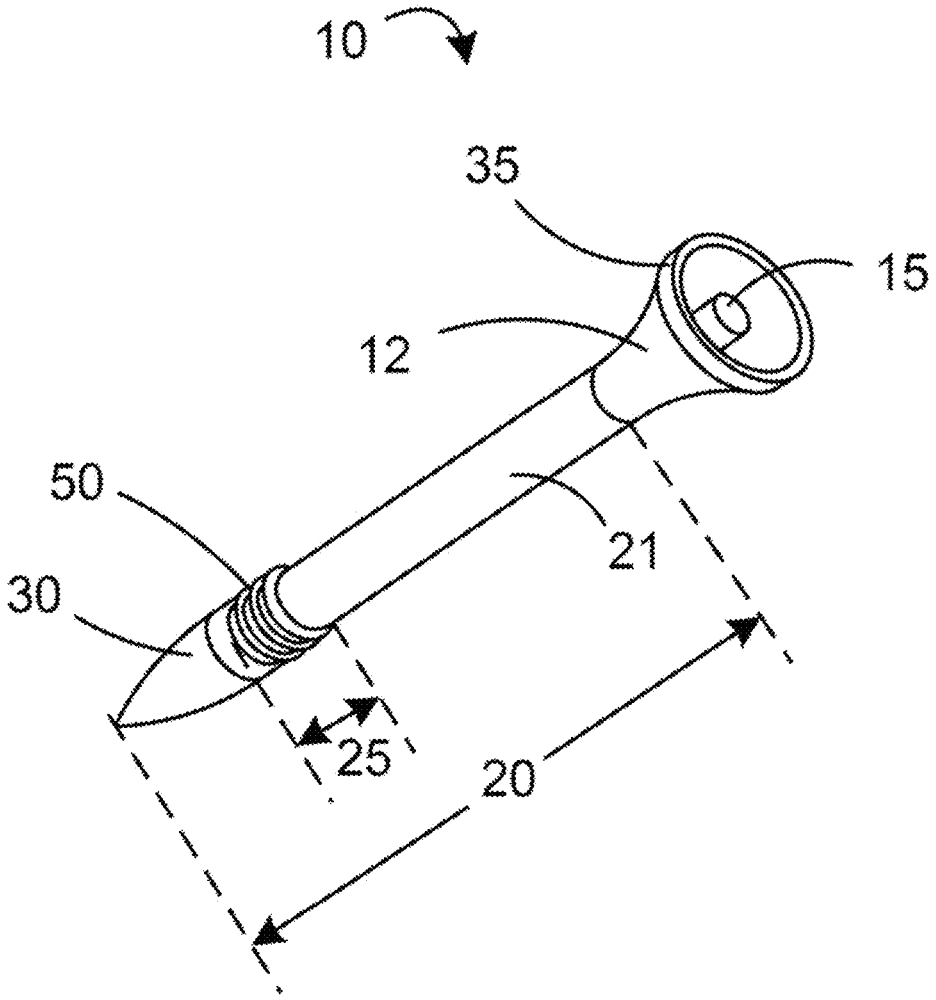
FIG. 3 is a perspective view of the golf tee, in accordance with the principles of the invention.

In FIG. 3, golf tee 10 has head 12 comprising wall 35 surrounding central pillar 15; body 20 is below the head 12 and includes a stem 21, a gripping ring structure 55 below the stem, and a terminal grounding tool 30 with pointy tip below gripping ring structure. The gripping ring structure 55 may include one or more rings 50, disposed around an extension of the stem 21.

Figure 4:
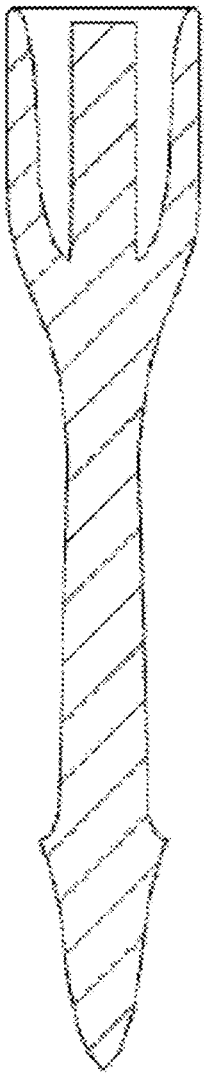
FIG. 4 is another front view of the golf tee, in accordance with the principles of the invention.

In FIG. 4, a cross-section of golf tee 10 is depicted.

Figure 5:
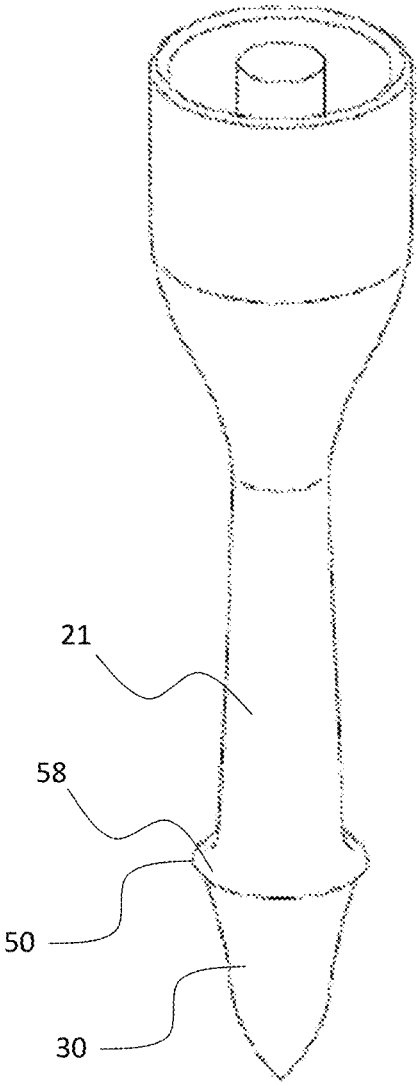
FIG. 5 is yet another front view of the golf tee, in accordance with the principles of the invention.

In FIG. 5, the top portion of golf tee 10 has head 12 and central pillar 15 and the bottom portion with its pointy tip. In this variant, a single gripping ring 50 wider than the stem 21 is present and is disposed right above the bullet-shaped grounding tool 30 to form an expanded upward-facing ledge 58.

In comparison to tees of common usage, head 12 is relatively large in diameter, at 12 mm-15 mm, but not as wide as tees of common usage that can be up to 20 mm. The width and inherent stability of head 12 provide structural support for holding the golf ball, while resisting a vertical compression force. This makes golf tee 10 easier to use, in contrast to many of the highly regarded and tees of common usage, including those with small heads, on which it can be difficult to balance the golf ball. The petal configuration and brush tee heads are flimsy and cannot accept the downward pressure required to press the tee into the ground in the conventional way, using a golf ball. The minimal-drag property of golf tee 10 is provided by a central pillar, which supports the weight of golf ball axially. The 'bowl-like' or 'chalice-like' structure of wall 35 of head 12 is thin-walled, with a thickness between 1.3 mm and 2.0 mm. This degree of thinness still allows stability against downward compression. There is a lower limit of thickness, which is approximately 0.8 mm, at which wall 35 could not perform this role adequately. However, the choice of construction materials plays a role in imparting sufficient stability against downward compression.

The performance characteristics of the head 12, in its interaction with the club's impact force, contribute to the objectives where: (i) golf tee 10 does not break (i.e., enhanced resilience against breaking); and (ii) golf tee 10 does not fly by virtue of C1, C2, C3, and C4.

C1: As wall 35 collapses, or springs in, on impact with the club, there is a buffered transfer of force to the stem and ground. For this function to be performed adequately, there is also a lower limit of thickness of wall 35 to provide an adequate degree of resistance for this buffering function. The lower limit is approximately 0.8 mm, but this limit also depends on the properties of the construction plastic. This buffering reduces jarring, with associated reduced risk of snapping the tee, as well as a reduced uprooting tendency.

C2: The said ability of the wall to spring in reduces the 'catching' potential, in comparison to a rigid head with a ledge. If the club is allowed to hook under the ledge of a rigid head, this can result in pulling the tee out of the ground or decapitation of the tee. Both of these tee failures are obviated by the 'chalice-like' head design of wall 35. Golf tee 10 relies on a suitable construction material.

C3: In comparison to the more solid head designs, the hollowness of head 12, or ball cup, reduces the mass of head 12. Thus, golf tee 10 is not top-heavy. In some embodiments of the present invention, the golf tee extends along a central axis Y, has a height L extending from a top of the head to the pointy tip along the central axis, and has a center of mass of the golf tee located at a distance of 40% to 60% of the height from the pointy tip along the central axis. In a non-limiting example, head 12 of the golf tee 10 comprises approximately 10-20% of the length of the tee and contains approximately 15-25% of the mass. This is in contrast to many of the tees of common usage, which have higher percentages of mass in the head, even over 70% for some designs. Due to its low mass and low center of gravity (center of mass), golf tee 10 does not accumulate enough momentum, when struck by a golf club, to be released from its grip in the ground. In contrast to the first style (or variant), the other styles have a larger head 12, which are also hollow and thereby do not overly concentrate mass in head 10, therefore maintaining the tee's center of mass at a distance of 40% to 60% of the height from the pointy tip along the central axis. The features of the grounded portion of the stem, which provide for the improved ground-holding ability of golf tee 10 over tees of common usage, are described more below.

C4: Regarding the 'chalice-like' wall configuration and said ability to collapse, or spring in and out, when struck from the side, there is an inherent strength and resilience in the continuous wall configuration in golf tee 10. This is in contrast to a wall configuration divided into 'petals', as seen in some tees of common usage. The primary advantage of the continuous wall configuration is the ability to withstand the vertical force of the golf ball, as used in the conventional way, to insert the tee into the ground. The 'petal configuration' tees, by not allowing this conventional and convenient tee-inserting technique, are comparatively more difficult to use. In comparison to the 'petal configuration', during and after an impact from the club, there is a deformation and a resilient springing back into the original shape of the integral 'chalice-like' wall configuration. The deformation resembles a blunt 'D' shape, in which the entire wall deforms. The sharing of the impact with the continuous wall helps to diffuse the impact force with resulting improved robustness and durability, in comparison to the 'petal configuration'. Additionally, the sharing of the impact helps the wall to spring back to its original form. As depicted in the figures, there is an increased thickness at the top, or rim section, in comparison to the lower section of the wall. This allows for a greater resilience at this impact zone and helps the rim to spring back into shape more readily, but this feature is not an essential feature of the two main functions that golf tee 10 achieves. The two main functions are the non-flying and non-breaking features, which are both adequately provided when this thickened rim is not provided.

Rim 45, as shown in FIG. 2, is the contoured, round, upper surface of wall 35. In an embodiment, the width of the rim is 1.3 mm and the upper surface of the rim is contoured to the standard sized golf ball. There is a vertical upper section of outer wall 40, which is 2 mm in height that allows a less sharp rim edge for more comfortable handling. It also allows the impact from the club to be distributed slightly, rather than for that impact to occur on a sharper edge. Impact occurring on the sharper edge may otherwise cause the edge to be dented or damaged more easily, but as noted above, in reference to an expanded thickness of the rim, this feature is non-essential for the two main functions of the invention. In the variant with the head more elongated into a cylindrical shape, the club impact zone becomes elongated and not only focused at the rim. This spreading of the impact zone allows for a more consistent and efficient shock absorption ability of head 12. The elongated head design also increases the mass of golf tee 10, which allows a greater momentum and uprooting tendency. Therefore, the beneficial effects of shock absorption are partially negated by the increase in mass. The choice of a longer or a shorter head may therefore be driven more by preference than by any overall degree of functional advantage of either option.

The head of the golf tee 10 has central pillar 15, as depicted in FIG. 3. Central pillar 15 has diameter of 3.8 mm at the top and tapers larger to 4.5 mm at the bottom. The height of central pillar 15 is determined by the conventional size of the golf ball. The golf ball rests on the ball cup and is in contact with the top of central pillar 15 and in contact with the rim of the 'chalice-like' wall 35. Thereby, central pillar 15 sits below the level of the rim. The thickness of central pillar 15 can range from 2.5 mm to 6 mm and would normally taper, as illustrated, due to the advantage of a taper in the injection molding process, which is the preferred manufacturing method utilized for golf tee 10. If the production method allowed, there may be zero taper, as the taper would not be required for the desired function. The hollowed out portion 60 is a void space that surrounds central pillar 15 and is bounded by wall 35 of the head, which is circular, and tapered into an approximately inverted cone shape.

C5, C6, and C7 are three purposes or useful functions of central pillar 15, which are described below.

C5: Central pillar 15 carries the weight of the ball axially, which minimizes the weight supported by the rim. This has the effect of reducing potential friction between the ball and the rim during the tee shot. While this function enables minimal friction, which is considered desirable, the ball platform configuration offers a markedly improved stability of ball-holding compared to the existing low-friction tees of common usage.

C6: Central pillar 15 provides further structural support to head 12 in the processes of grounding the tee and withstanding a 'miss-hit' in which golf tee 10 and ball are driven downwards.

C7: Central pillar 15 provides structural protection to the chalice-like wall, by acting as a buttress. Thus, central pillar 15 prevents over-flexion and resulting damage to wall 35.

Body 20 of golf tee 10 refers to the solid continuation from the base of head 12 and extends to the sharp tip. Body 20 has three sections: (S1) stem 21 below the head 12; (S2) gripping ring structure below the body; and (S3) bullet-shaped or torpedo-shaped grounding tool below the gripping ring structure. The non-expanded continuation of the stem ends in formation of a pointy tip. The gripping ring structure and the bullet-shaped grounding tool are formed by the expansions from the stem. If the bullet-shaped structure is removed, then the remaining portion is a continuation of the stem ending with the formation of a pointy tip. This section may remain without an additional ring or rings in place of the grounding tool or contain additional rings or may include an additional ring or a series of rings, gradually decreasing in diameter.

Body 20 may be a long format. Within the scope of the systems and methods herein, there are variants where the tee is marginally longer and where the tee is shorter. The properties of the stem, based on material composition, structure, and dimensions, contribute to stated objectives. The depth of ground-insertion of the stem is an important variable that also contributes to the stated objectives and is therefore included in this description. The stem, as depicted in the figures, has a diameter of 6 mm, where the utility objectives of robustness and remaining in the ground are achieved. With the appropriate plastic composition, a stem thickness ranging from approximately 5 mm to approximately 7 mm are dimensions for achieving the robustness and remaining in the ground. Shorter variations of the golf tee 10 suit a narrower stem, while longer variations suit a thicker stem. The stem is non-tapering all the way to the 'bullet-shaped' section 25, which culminates in pointy tip 30. This configuration of stem is thicker than known solid-stemmed tees. This increase of thickness and lack of tapering, leads to increased degree of rigidness and robustness. Contributing to this is the strong composition material. A degree of flexibility is maintained, which is an important factor in the improved performance properties of golf tee 10.

By contrast, 'step-up' or 'step-down' tees have hollow tube stems, usually with a waist that are: (i) non-flexible and (ii) wider in diameter than golf tee 10, down to the level of the 'step'. The buried lower section of the 'step tee' is solid, but significantly narrower than golf tee 10, with a thickness of 4 mm to 4.5 mm. The 'step' provides a consistent height, which can be preferred, but requires several sizes to be available to suit the various club selections. Thus, a golfer needs to be prepared with enough tees of each variety to cover for losses and breakages, which is not convenient. While being a best seller, cheap, relatively durable, and tending not to fly very far, this type of tee of common usage tends to exhibit the following fracturing tendencies: (F1) breaking at the ground level; (F2) snapping through the waist; or (F3) splitting vertically or obliquely from the top. This occurs often through the join, when the ball is miss-hit by 'topping'. In the 'topping' situation, the step resists downward travel of the 'step tee' of common usage, thereby exposing the stem to an explosive compression force. These weaknesses of the 'step tee' varieties result in the littering around teeing grounds. Golf tee 10, with the (S1) stem configuration as shown, does not exhibit fracturing tendencies F1-F3. Therefore, golf tee 10 is more durable. The height of golf tee 10 is also adjustable, which can be an advantage over the 'step tee', which is not height adjustable. The step of the 'step tee' provides minimal effects against flying and so the 'step tee' usually flies after being struck, which is an inconvenience that golf tee 10 also avoids.

The increased thickness of golf tee 10 imparts increased strength, robustness, and rigidity, while maintaining a degree of flexibility for absorbing some of the impact force. The increased sturdiness aids insertion into firmer teeing grounds. This offers increased utility over the existing plastic tees of common usage that are tapering and thinner. While this greater degree of flexibility of existing plastic tees of the tees of common usage is utilized to protect them from fracturing, these tees are: (i) often unable to be inserted into firmer ground; and (ii) prone to 'snaking' out of the ground, especially the top-heavy variant, which can fly 10 meters and is therefore very prone to getting lost. In contrast, golf tee 10 stays securely in the ground over 95% of the time or in close proximity to its insertion point in the rare case of golf tee 10 coming out of the ground. The increased rigidness of the stem of golf tee 10, and especially the grounded section, and also the said lower-mass head design, prevent this 'snaking' and thus help golf tee 10 to remain in the ground. Therefore, golf tee 10 relies on localized energy dissipation into: (i) said springiness of the 'chalice-like' wall of the head, (ii) said degree of flexibility and elasticity of the stem, and (iii) energy dissipation into the ground, which yields under the leverage force. This is in contrast to the existing tees of popular usage, that have flexible stems, and high centers of mass, which can fly up to 10 meters and be easily lost or consume time in fetching.

Optimal performance of golf tee 10 is achieved when golf tee 10 is inserted to a point where between 25% and 50% of the length of golf tee 10 is buried. This allows adequate energy dissipation by the said mechanisms, which protect golf tee 10 from damage. By burying the tee deeper than this optimal range, there is less of the stem available for energy absorption. The ground-grip also becomes less yielding, such that with each increment of depth, there is a corresponding increase in focus of force and stress applied to the smaller section of the tee. This stress is greatest at ground level, especially if the ground is firm and becomes problematic when 50% or more of the tee is buried. In this scenario, the impact is solid and felt as a jarring through the club and into the hands of the golfer. Therefore, golf tee 10 is preferred to be used in said optimal depth range or to a maximum of 50% to avert this risk. Fairway woods and hybrid clubs are marginally less likely to create this tee-damaging scenario than irons. An impact with the tee would always be at the rim of the chalice-like wall, which is flexible, and the base of these clubs is blunt. Even with this proviso, the risk of damage to the tee increases the deeper the tee is buried. A partial exception is situations where the tee is inserted maximally, whereby only the head or part of the head is above ground. In this scenario, there is a better chance of avoiding damage to the tee, especially while using woods or hybrids, as the only part of the tee, which is vulnerable to being hit, is the flexible head. A protective factor in all of these deeper tee scenarios is a wet and soft ground, which absorb impact energy from the buried portion of the tee and yield in decreasing degrees from ground level downwards and possibly all the way to the buried tip of the tee. The below-ground cooperative features of golf tee 10 and the energy-dissipating interaction with the ground under an impact force are described below.

Figure 6:
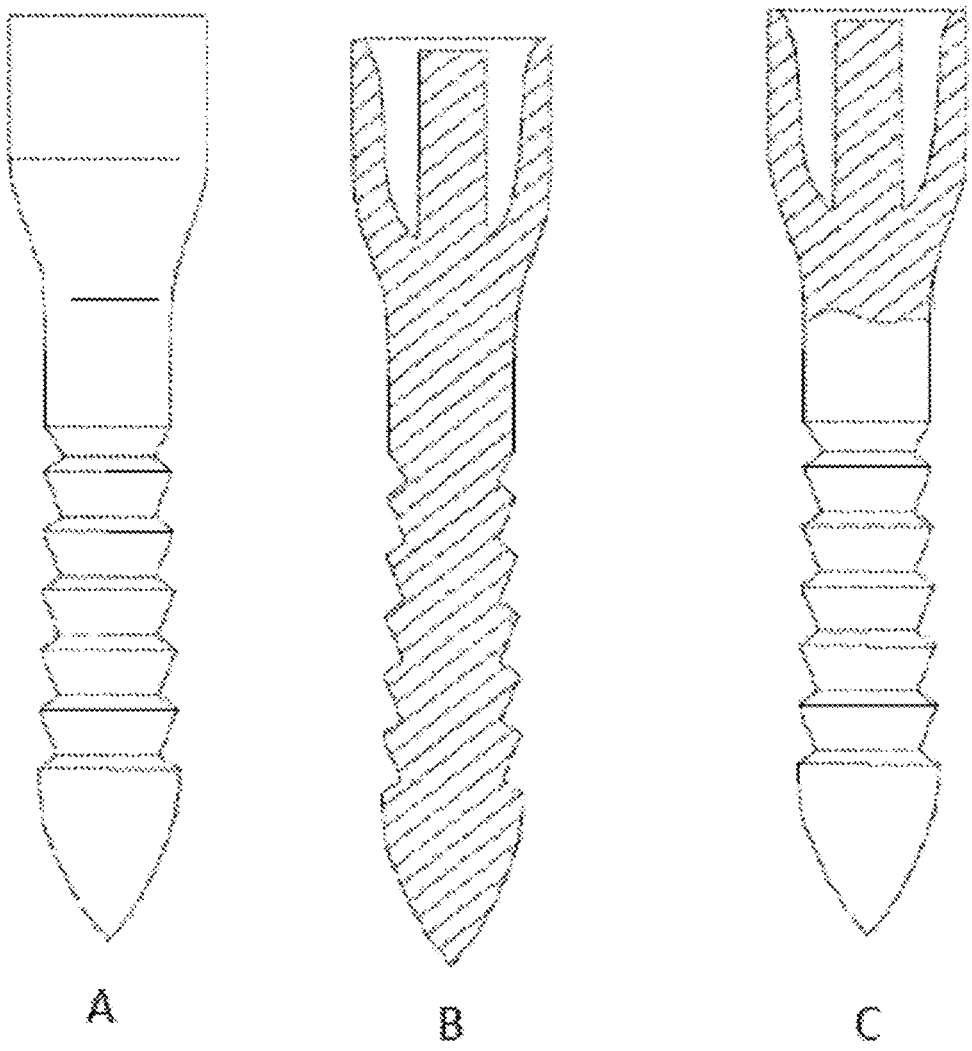
FIG. 6 is a front view of a wider golf tee with a series of grooves, in accordance with the principles of the invention.

Serrated gripping rings, in a variant, may be sharp edged and ring-like expansions of the stem, as depicted in FIGS. 1-5. Note that in another variant, if the stem is the diameter of the outer diameter of the gripping rings, it appears that the rings are created by circumferential, upright 'L'-shaped grooves, rather than expansions from the stem, as shown in FIG. 6. In some embodiments, the gripping rings are created by 'C'-shaped grooves in the stem. In FIGS. 1-5, it is observed that the side profile of the rings each resemble an inverted 'L', with a slightly acute angle. A range of angles, curves, as depicted in FIG. 6, sharpness, intervals, side lengths, side length ratios, and number of rings may be applied to satisfy the same purpose. These rings are positioned on the body, above the 'bullet-shaped' grounding tool. The rings positioned on the body are intended to be buried in the ground when the golfer sets up for a tee shot. Note that it is not necessary for the functioning of golf tee 10 that all of the rings be buried. But the more shallowly the tee is buried, and therefore the fewer gripping rings in contact with the ground and grass roots, the more likely the tee is to fly off the ground. The walls of the rings 50, as depicted with an inverted L-profile, are angled to face downward and outward to allow lower-friction insertion into the ground, while allowing the shorter of the two faces to provide an upward-facing ledge 58. In an impact with the club, which typically occurs at the rim of the head, there is a leveraged force transmitted through the head and the stem to the ground. The rings are driven horizontally against the upper front of the tee tunnel. This is the crucial point of functional difference from existing inventions, where the grips have been placed at the tip. Depending on the firmness of the soil, this interaction creates a blunt fulcrum or tee-pivoting region. In this lever-like force delivery and transmission, the rings are interacting with the fulcrum region and in so doing stabilize the interaction. The upward-facing ledges and sharp edges when driven approximately horizontally against the ground and roots, oppose upward motion of the tee. Note that the interaction with the roots is a new concept, which has not been recognized as important in existing inventions but is vital in the functioning of golf tee 10. Therefore, golf tee 10 is prevented from projecting out of the ground. In this interaction, there is typically a disruption of the ground. The degree of disruption depends on the firmness of the soil and the density of the grass roots. In typical ground conditions, the section of the stem distal to the rings is driven backwards in this leveraged interaction, thereby disrupting the ground to a varying degree. At and above the level of the gripping rings, the disruption also involves the front of the tee-tunnel where the tee dents the ground in a forwards direction. This forward denting is partially limited by the grass roots. The actions of the bullet-shaped lower end section, at insertion and in energy dissipation, are described below.

When golf tee 10 is buried deeper such that the gripping rings are below the fulcrum region, the effect of the rings is to produce a friction interaction with the back wall of the 'tee tunnel'. The nature of this interaction also depends on the firmness of the soil. In this interaction, there is more of the body buried. Thus, there is a greater overall holding-power exerted by the ground. The flexing of golf tee 10 around the fulcrum bows the gripping rings backwards, to a degree that depends on the soil density. Then, the gripping rings exert a greater friction against the more compacted deeper soil of the posterior wall. In this scenario, golf tee 10 is not ejected from the ground. As previously noted, there is a more focused stress applied to the above-ground section of the tee and greatest at ground level.

In an embodiment as illustrated in the first style example, the gripping rings have an outer diameter of the rings of 8 mm, while the diameter of the stem is 6 mm, leaving 1 mm radius for the rings. Due to the angle, the actual width of the ledge of the rings is about 1.1 mm. The perimeter of the rings is over 2.5 cm, while the perimeter of the grounded section of existing tees is less than 1.5 cm. The effective range of diameters for the said gripping rings is approximately from 7 mm to 10 mm. The width of the ledge of each gripping ring ranges from 0.5 mm to 3 mm. The width of the ledges depends on the difference in the outer diameter of the rings and the diameter of the stem or the section of stem that is associated with the rings. Note that the diameter of each gripping ring need not be equal within a single example of golf tee 10. Following the tee shot, golf tee 10 is typically still standing in the ground and the soil around it is loosened. Golf tee 10 is also then often tilted forward, thereby can be easily retrieved. As the soil is loosened, even if the tee is still standing, it is advisable to replant golf tee 10 when the tee shot needs to be taken again. This is attributed to the compactness of the soil as an important tee-holding factor. If the tee shot is taken again without replacing golf tee 10, there is an increased likelihood that golf tee 10 is ejected from the ground. Even in this situation, golf tee 10 does not travel far.

If the recess between the rings is sharp, dirt can be trapped, which typically falls off as the dirt dries. In an embodiment, the crevices between rings are rounded out to help remedy the trapped dirt. The low-friction construction material also helps to avert dirt trapping.

In an embodiment, the friction rings are created as grooves, rather than expansions from the stem, as depicted in FIG. 6. Where the grooved section extends from the top of the bullet-shaped grounding tool, and up to a level that exceeds the ground level, this configuration allows for an above-ground grooved section of the stem. This exhibits less rigidity and more flexibility. An advantage of this configuration is an increased suitable depth range, in which gripping rings are present at the top of the tee tunnel, to perform well for a greater range of ball heights. Another potential advantage is a protective factor of the above-ground 'flex-zone', given a suitable construction material that accepts flex well and is not brittle. For the grooved configuration, body 20 needs to be wider and heavier to accept the grooves and still allow enough strength in the grooved section. The choice of construction material is integral in the performance characterization of this style of golf tee 10, as with all potential styles herein.

Designs A, B, C, and D of golf tee 10 are of different styles, while achieving the objective where golf tee 10 is highly functional with a secure ball cup; height adjustable to suit every tee shot; and resistant to breaking and flying out of the ground.

Golf tee 10 relies on suitable construction material. It is intended that golf tee 10 be constructed using injection molding of a 'thermoplastic'. Multiple varieties of thermoplastics exist and their properties depend on the molecular composition of the polymer, which can have varying lengths, degrees of branching, and varying intermolecular bond strengths. Fillers are also added to increase hardness and strength.

Most existing plastic golf tees are constructed from high density polyethylene (HDPE) or polypropylene. These plastics are strong, weather resistant, and fracture resistant. They are also cheap. For situations where greater rigidity is needed, such as for thin tee varieties, additives can be used to create composites. However, composites are prone to snapping.

The design of golf tee 10 uses the flexibility, which is found in many plastics, to absorb the impact force of the club, and resilience to return to its original shape after the deformation. However, golf tee 10 is designed to uniquely harness this flexibility and resilience, to provide both durability and a tee that can remain in the ground, which has never yet been achieved in a single component tee. The design of golf tee 10 also uses a greater thickness than ever seen before to achieve this advanced sturdiness essential to its functions and increased versatility in different soils.

Figure 7:
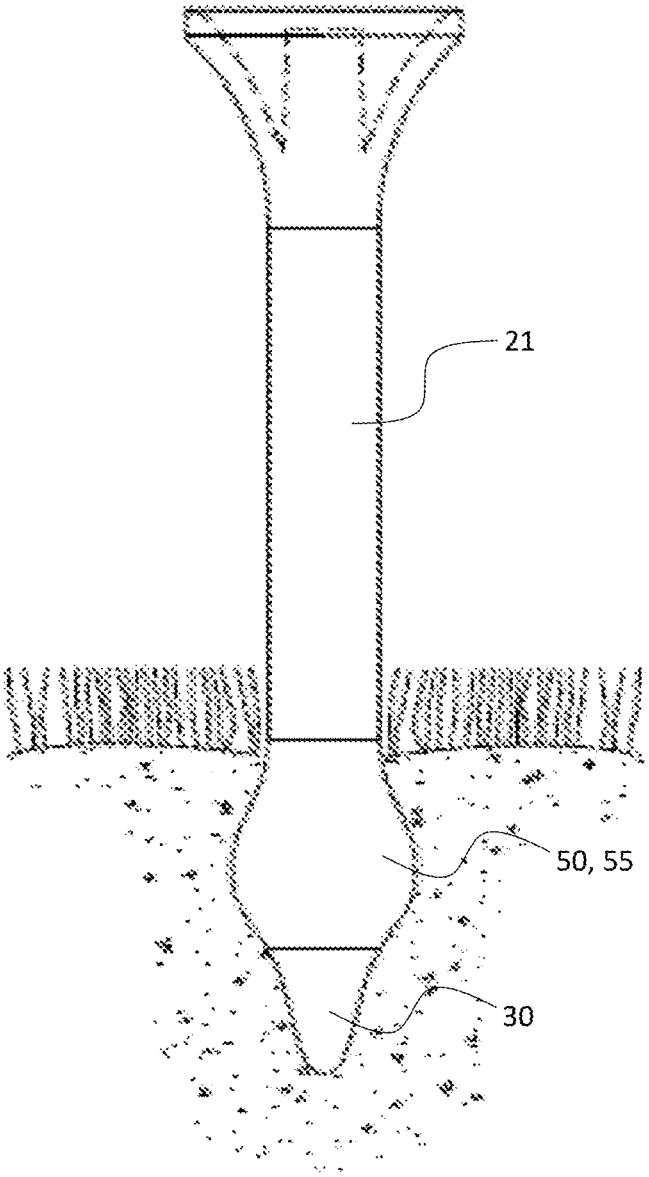
FIG. 7 is a front view of a golf tee, which has a bulb-shaped gripping ring, in accordance with the principle of the invention.

In an embodiment, gripping ring 50, which is singular, large, and bulbar shaped, preferably with a shorter bullet-shaped grounding tool 30, offers a suitable set of performance characteristics, as depicted in FIG. 7. The said fulcrum or tee-pivoting region is stabilized at the bulb, which allows for rotation of golf tee 10. In this rotation, grounding tool 30 cuts through the ground, which is an energy dissipating action. The grounding tool is therefore smaller to allow this rotation. The upper curve of the bulb, where it merges into the stem 21 above, provides reinforcement at the point of the stem that is most under stress during impact. The increased range of rotation allowed by this single bulb-like ring is also protective of golf tee 10. Owing to the altered grounding tool and gripping ring dimensions, this variant of golf tee 10 may be most suited to the softer range of teeing ground conditions. The matted grass roots through which the bulb-like gripping ring is inserted with the aid of 'grounding tool', remains an important factor in efficacy of the bulb in gripping and rotating. Therefore, this grass root layer significantly and efficiently interacts with the attributes of all of the potential styles of golf tee 10 and contributes to the performance objectives of 'non-breaking' and 'non-flying', which are not achieved in any existing single component golf tee.

In an embodiment, the distal end section of golf tee 10 is referred to as the 'bullet-like' or 'torpedo-like' grounding tool 30. This couples with the said gripping rings 50 with pointy tip 30 to form a functional unit. The widest part is 7.0 mm, which is 75% thicker than the standard tees that are 4.0 mm in diameter in the grounded section. The workable range of potential thicknesses for this section is from 6.0 mm to 10.0 mm. This thickness and the gradual curve of its profile are novel and unique amongst tees. In comparison, the standard tee tip of tees of common usage, whether the stem is tapered or non-tapered, is pencil-tip-like. The less common curved-tip varieties have a more abrupt curve and are significantly thinner, typically 4.0 to 4.5 mm in maximum diameter. The grounding tool cooperates with the gripping rings, the stem, and the head to achieve the stated objectives of a tee that does not break and does not fly. The grounding tool creates the tunnel, when the golfer presses it into the ground. The robust shape and composition of the grounding tool, combined with the increased robustness of the entire tee, allows the grounding tool to function in a higher range of soil conditions. The curve of the grounding tool's profile is gradual and allows for soil compaction, which increases the ground-holding capability of the present invention. The increased diameter of the grounding tool 30, over existing tees, increases the surface area of contact with the soil and the pressure of this interaction, which increase friction and ground-holding ability. The relative lack of flex in the grounded section of the golf tee 10 does not allow for the 'snaking' effect. The thickness of the grounding tool enables a wider tunnel to be formed. This allows said gripping rings to be inserted with ease, as aided by said angulation to favor a low-friction insertion. The robustness, the non-flexing nature of the grounding tool, and said curve cooperate with all of the other parts of golf tee 10 for achieving the stated performance objectives. During a tee shot, in which golf tee 10 is impacted by the club, the leverage force dictates that the grounding tool is driven backwards. In this backwards motion there are: (i) a disruption of the soil, by way of the gradually narrowing and sharpened tip of the grounding tool 30 breaking the integrity of the surrounding soil; and (ii) a tendency for the curved back edge of the grounding tool to slide up, against the posterior wall of the tunnel. Golf tee 10 tends to lift slightly due to the disruption of the soil and tendency of the curved back edge. Said ledges of the gripping rings, which are concurrently being forced against the compacted tunnel's upper anterior wall and grass roots, strongly and directly oppose this lifting. Both the soil-disrupting and sliding-up actions of the grounding tool are important energy dissipating actions, which protect golf tee 10 from damage.

In some embodiments of the present invention, the top of grounding tool 30 is slightly wider than portion of the body that is surrounded the rings. In his manner, a second ledge 59 is created at the top of the bullet-shaped grounding tool to offers additional friction to resist uprooting, by acting as a narrower version of the ledges 55 of the friction rings above it. In the embodiment shown in the first illustrated style (FIGS. 1-3), ledge 59 is 0.5 mm wide. In other embodiments, ledge 59 may be as wide as 3.0 mm. Owing to the position of ledge 59 as the deepest of the upper ledges 55 when golf tee 10 has been grounded in typically more compacted soil, a significant frictional effect is exerted during the said impact interaction. This contributes to the stated objective of golf tee 10 remaining in the ground following the tee shot impact. Ledge 59 may be straight or curved in a cross-section.

In the embodiment shown in the second illustrated style (FIGS. 4 and 5), the gripping ring structure has the appearance of a sharp lip-like expansion with a ledge 55. Rings at a wider diameter than the grounding tool increase gripping capability, such as the thread on a screw. This gripping capability is partially negated by a wider grounding tool or narrower rings, such as the situation where the grounding tool was wider than the gripping rings.

In an embodiment, there is a grounding tool with an enhanced ledge 55, which incorporates a lip to create a single gripping ring, and no additional gripping rings. Experimentation with such a prototype of golf tee 10 reveals a high degree of efficacy for the percentage of tee shots in which the tee remained in the ground, which was between 90 to 95%. The efficiency of multiple gripping rings is between 95 to 100%, depending on the soil type and the amount of grass and density of grass roots.

The material composition of golf tee 10 is a thermoplastic suitable for the manufacturing technique of injection molding. Common thermoplastics include: high density polyethylene (HDPE), polypropylene, and nylon. The properties of the applicable thermoplastic are the best balance of lightness, impact resistance, low-friction surface, hardness, resilience, durability, flexibility, and the ability to hold color. All of these properties are required for achieving the stated objectives, but some of the properties are mutually exclusive (e.g., hardness and flexibility), hence the requirement for the optimum balance of the properties. Polypropylene prototypes have been produced, which successfully achieve the stated objectives despite less than ideal hardness. These prototypes have never broken or been lost through one year of regular use, in average soil conditions. The best property of polypropylene is its degree of hardness, which is adequate, while being very low in weight or mass. This makes polypropylene-based golf tee 10 robust in the harder soil conditions, but there is a tendency for the tip to become blunted over time, but still usable. The other engineering plastics have their own disadvantages, including nylon's issue with its interaction with hydration and the high cost and difficult processing of the other engineering plastics.

Figure 8:
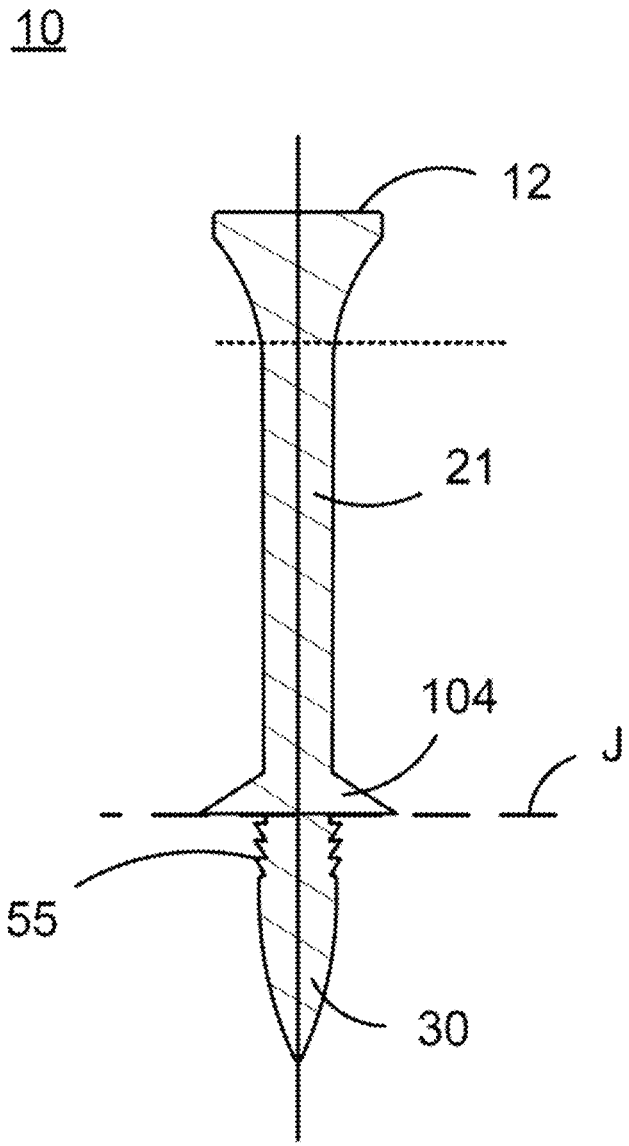
FIG. 8 is a front view of a golf tee having a skirt extending from the stem so that the a bottom of the skirts touches the ground when the gripping ring structure is fully buried into the ground, according to some embodiments of the present invention.
Figure 9:
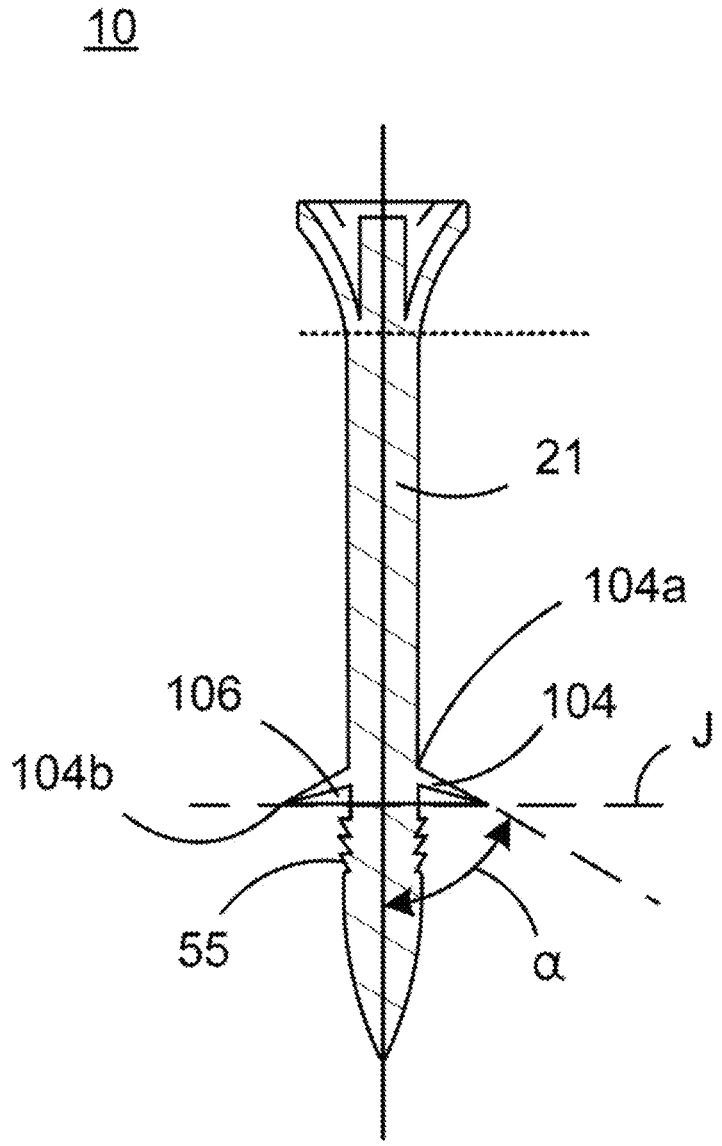
FIG. 9 is a front cross-sectional view of the golf tee of FIG. 8.
Figure 10:
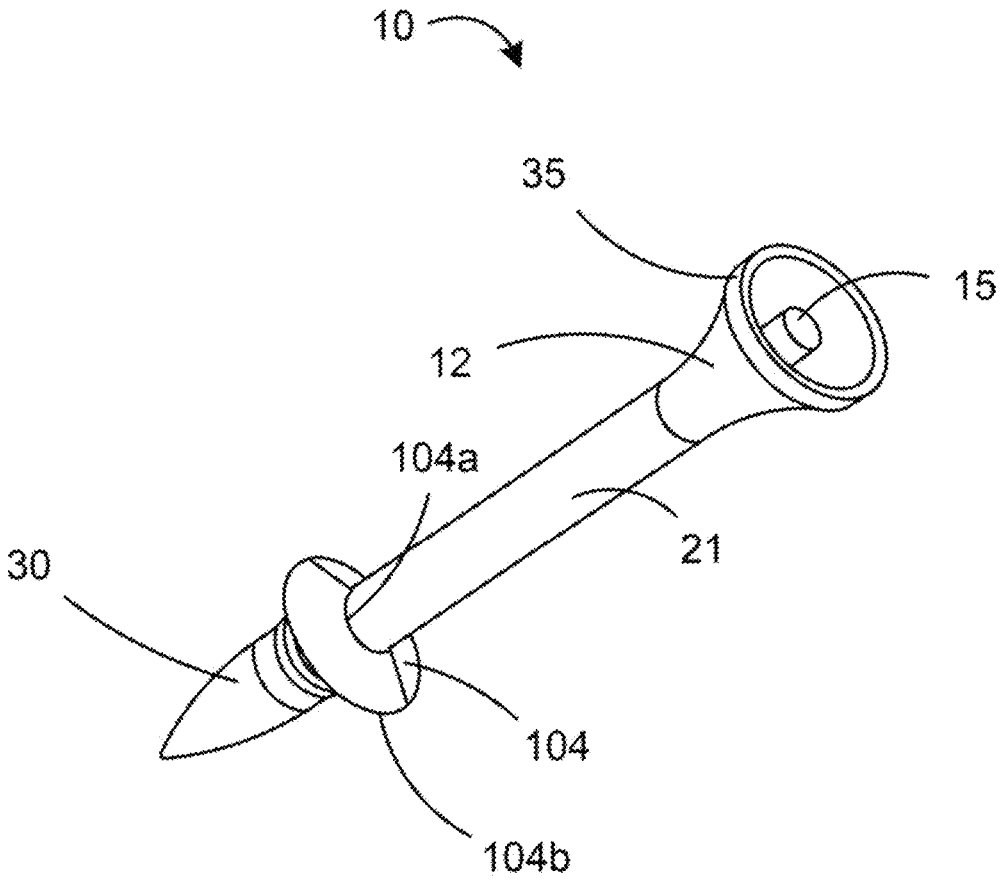
FIG. 10 is a perspective view of the golf tee of FIGS. 8 and 9.

In the embodiments shown in FIGS. 8-10, the golf tee 10 has a skirt 104 extending diagonally downward from the stem 21. The skirt 104 surrounds at least part of the stem 21.

The skirt has a top circumference 104*a* joined to the stem and a bottom circumference 104*b* larger than the top circumference. The bottom circumference 104*b* may be vertically aligned with a junction J between the stem 21 and the gripping ring structure 55, or may be disposed slightly above the junction J. In this manner, the bottom circumference touches the ground when the gripping ring structure 55 is fully buried into the ground. Below the top circumference 104*b* a hollow space 106 is formed between the skirt 104 and the stem 21. This enables a user to consistently place the tee into the ground at the same height and ensure that the gripping ring structure 55 is fully buried into the ground.

The skirt 104 is inclined at a non-zero angle $\alpha$ with the central axis of the tee. The angle $\alpha$ may be between 75 and 80 degrees—which makes it possible for the tee to be easily manufactured via injection molding.

The skirt 104 digs into the ground like a spade, because when the tee is struck, the whole tee travels forward in the ground.

Without the skirt 104, when the tee is struck, there is a flexing of the whole tee. The above-ground section of the tee flexes the most, especially at the ground interface. Therefore, the ground is getting 'cut' by the tee. This may somewhat loosen the grip held by the grounded section. So, when the tee recoils back after its initial forward flex, there is a chance that the tee may spring out of the ground, backwards.

The downwardly angled skirt 104 reduces the ground loosening by reducing forward travel of the grounded section, by pressing against the ground. This preserves some grip to protect the tee from flying out during the recoil.

As the (reduced) forward flexion occurs, the edge of the skirt digs into the ground during the forward driving phase, which therefore reduces the lifting or 'snaking out' tendency.

With a tighter ground grip and reduced lifting tendency, the recoil phase will be significantly less likely to eject the tee (backwards).

Figure 11:
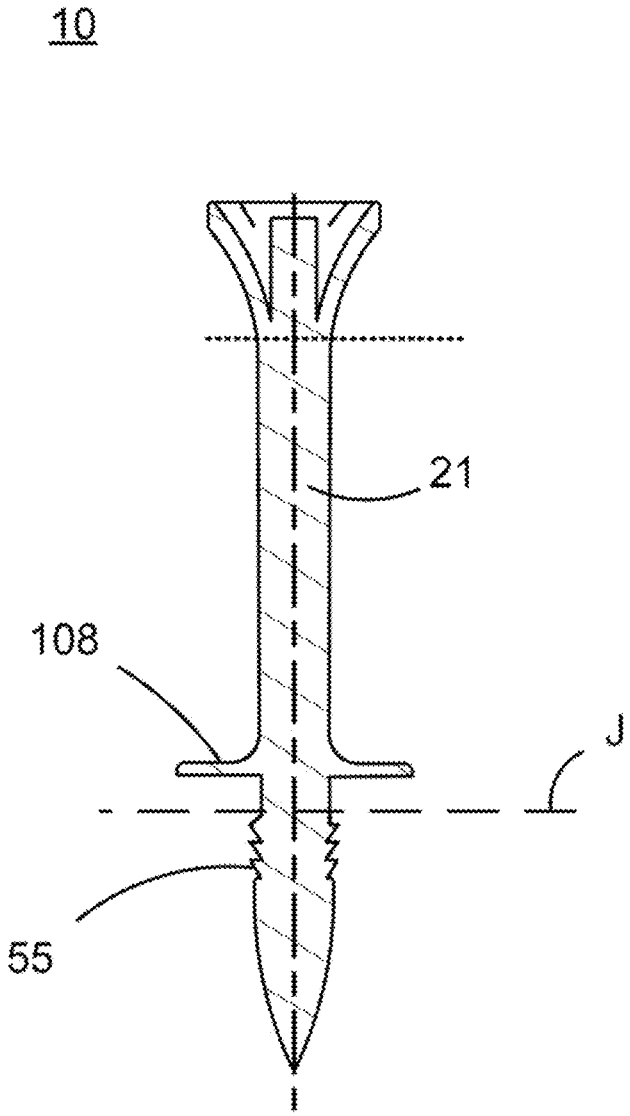
FIGS. 11 and 12 illustrate tees having a flat skirt extending radially out of the stem, according to some embodiments of the present invention.
Figure 12:
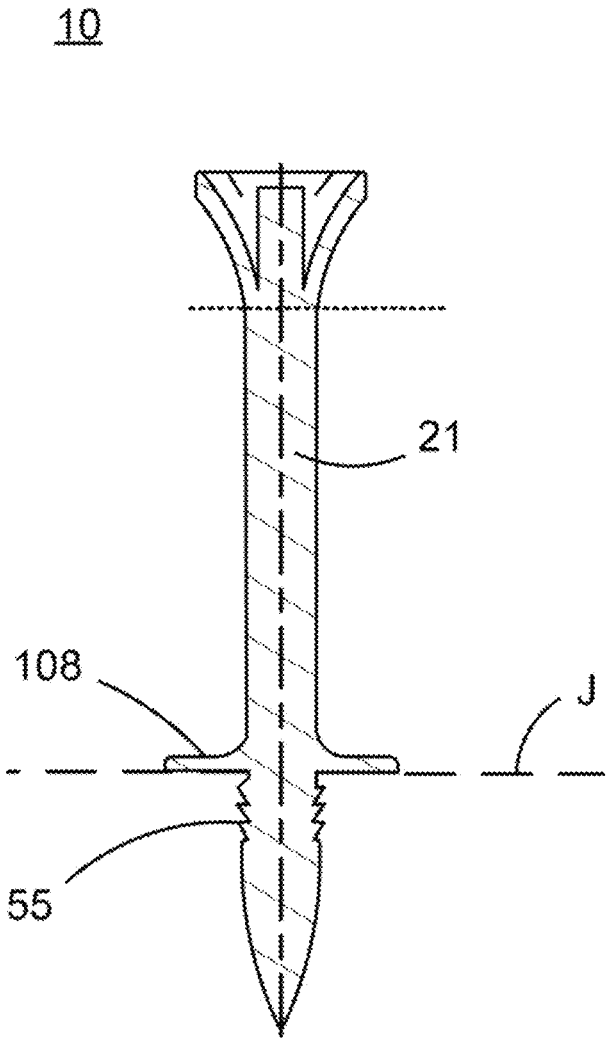

FIGS. 11 and 12 illustrate tees having a flat skirt 108 extending radially out of the stem 21, according to some embodiments of the present invention.

The flat skirt 108 enables a user to consistently place the tee into the ground at the same height and ensure that the gripping ring structure 55 is fully buried into the ground to ensure that the full gripping potential is achieved. In some embodiments of the present invention the flat skirt 108 has a base slightly above with the junction J between the stem 21 and the gripping ring structure 55, as seen in FIG. 11. In some embodiments of the present invention the flat skirt 108 has a base aligned with the junction J between the stem 21 and the gripping ring structure 55, as seen in FIG. 12.

Going back to all of the embodiments of FIGS. 1-22, the inventor has found that in golf tees of the prior art that are known to fly the farthest (which is up to 10 meters), it is seen that the center of mass is the highest of all golf tees in common usage. The inventor therefore arrived at the understanding that, in the prior art, the part of the tee that interacts and connects the tee with the ground is proportionally smaller and of low mass. The 'snaking' phenomenon, that occurs in this situation, has been explained.

In view of the above, the inventor has understood that a tee with a lowered center of mass will naturally be more stable against being uprooted and flying, as explained above. Another important factor in the stability of the tee is the portion of the overall mass that interacts with the ground.

In some embodiments of the present invention, the golf tee 10 of the present invention, attributes its stability to not only its lowered center of mass but also the proportion of that mass interacting with the ground. Compared to all other golf tees in common usage, the golf tee 10 of the present invention has a greater proportion of its mass interacting with the ground. For example, in some embodiments of the present invention, about 35% to 50% of the tee's mass is formed by the gripping ring structure 55 and the terminal grounding tool 30 (thus, about 35-50% of the tee's mass are below the junction J). This fact, along with the other said gripping and shock absorbing features described above, is an important point of understanding how golf tee 10 can surpass any other single component tee in its ability to remain in the ground after impact. While the degree of insertion is therefore important, there is no set point for insertion of any tee that guarantees 100% that the tee will remain in the ground. The skirt feature options, as illustrated in FIGS. 8-12, provide for an accurate teeing height, that also fulfills the depth of insertion requirement for a high degree of stability.

While various embodiments of the present invention have been described above, it should be understood that they have been presented by way of example only and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical, or physical partitioning and configurations can be implemented to accomplish the desired features of the present invention. Also, a multitude of different constituent module names other than those depicted herein can be applied to the various partitions. Additionally, with regard to operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document and variations thereof, unless otherwise expressly stated, should be construed as open ended as opposed to limiting. As examples of the foregoing: the term "including" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. In addition, when a single callout line in the drawings leads to two or more separate reference numbers (first, second, etc. reference numbers), (and each reference numeral refers to a different piece of text in the detailed description) and it would be inconsistent to designate the drawing item being called out as both pieces of text, the drawing should be interpreted as illustrating two different variants. In one variant, the drawing item is referred to by the first reference number and in another variant, the drawing item is referred to by the second reference number, etc.

The presence of broadening words and phrases such as "one or more," "at least," "but not limited to," or other like phrases in some instances shall not be read to mean that the narrower case is intended or required in instances where such broadening phrases may be absent. The use of the term "module" does not imply that the components of functionality described or claimed as part of the module are all configured in a common package. Indeed, any or all of the various components of a module, whether CTRL logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A golf tee, comprising:

a head configured to support a golf ball;

a body operatively connecting to the head and located below the head, and the body comprises: a stem below the head, a gripping ring structure below the stem, and a terminal grounding tool below the gripping ring structure, wherein the gripping structure is configured to be at least partially buried in a ground in which the golf tee is lowered and to grip the ground, and wherein the terminal grounding tool culminates in a pointy tip;

a downwardly sloping skirt surrounding at least part of the body, the skirt having a top circumference joined to the body and a bottom circumference larger than the top circumference, wherein below the top circumference a hollow space is formed between the skirt and the body, the skirt being configured such that the hollow space is maintained when the bottom circumference contacts the ground and is driven into the ground, wherein a thickness of the skirt decreases from the top circumference to the bottom circumference.

2. The golf tee of claim 1, wherein:

the downwardly sloping skirt surrounds at least part of the stem, the top circumference is joined to the stem, and is vertically aligned above a junction between the stem and the gripping ring structure, wherein below the top circumference the hollow space is formed between the skirt and the stem.

3. The golf tee of claim 1, wherein an angle between a central axis along which the body extends and an inclined surface of the skirt connecting the top circumference and the bottom circumference is between 75 and 80 degrees.

4. The golf tee of claim 1, wherein the tee is formed as a single piece of material.

5. The golf tee of claim 4, wherein the tee is made by injection molding.

6. A golf tee, comprising:

a head configured to support a golf ball;

a body operatively connecting to the head and located below the head, and the body comprises: a stem below the head, a gripping ring structure below the stem, and a terminal grounding tool below the gripping ring structure, wherein the gripping structure is configured to be at least partially buried in a ground in which the golf tee is lowered and to grip the ground, and wherein the terminal grounding tool culminates in a pointy tip;

a downwardly sloping skirt surrounding at least part of the body, the skirt having a top circumference joined to the body and a bottom circumference larger than the top circumference, wherein below the top circumference a hollow space is formed between the skirt and the body, wherein a thickness of the skirt decreases from the top circumference to the bottom circumference.

* * * * *